US008783539B2

(12) United States Patent
Yang et al.

(10) Patent No.: US 8,783,539 B2
(45) Date of Patent: Jul. 22, 2014

(54) ADJUSTING MECHANISM FOR NAILING POWER OF NAILING GUN

(75) Inventors: Mingjun Yang, Wenling County (CN); Zhongji Chen, Wenling (CN); Yuanhu Su, Wenling (CN)

(73) Assignee: Taizhou Dajiang Ind. Co., Ltd., Wenling, Zhejiang (CN)

( * ) Notice: Subject to any disclaimer, the term of this patent is extended or adjusted under 35 U.S.C. 154(b) by 381 days.

(21) Appl. No.: 12/864,090

(22) PCT Filed: Sep. 18, 2009

(86) PCT No.: PCT/CN2009/074018

§ 371 (c)(1),
(2), (4) Date: Apr. 5, 2011

(87) PCT Pub. No.: WO2011/003248

PCT Pub. Date: Jan. 13, 2011

(65) Prior Publication Data

US 2011/0174858 A1 Jul. 21, 2011

(30) Foreign Application Priority Data

Jul. 7, 2009 (CN) ..... 2009 1 0100556

(51) Int. Cl.
*B25C 1/04* (2006.01)

(52) U.S. Cl.
USPC ..... 227/142; 227/130

(58) Field of Classification Search
USPC ..... 227/8, 130, 142; 173/169, 115
See application file for complete search history.

(56) References Cited

U.S. PATENT DOCUMENTS

| | | | | |
|---|---|---|---|---|
| 2,914,033 | A * | 11/1959 | Powers et al. | 91/45 |
| 3,042,008 | A * | 7/1962 | Liesse | 123/46 SC |
| 3,081,742 | A * | 3/1963 | Goldring et al. | 91/454 |
| 4,821,941 | A * | 4/1989 | Cotta | 227/130 |
| 7,316,341 | B2 * | 1/2008 | Schnell et al. | 227/130 |

* cited by examiner

*Primary Examiner* — Thanh Truong
*Assistant Examiner* — Nathaniel Chukwurah
(74) *Attorney, Agent, or Firm* — Global IP Services; Tianhua Gu

(57) ABSTRACT

An adjusting mechanism for nailing power of nailing gun, comprising: a slot which is arranged in an upper aluminum cap and is co-axial with an air cylinder, so that the balanced valve airtight slides in the slot, the front side of the balanced valve is exposed to a main chamber, and the rear side of the balanced valve encloses with the inner surface of the upper aluminum cap to form a control chamber; the travel distance of the balanced valve is restricted between the cylinder and a cushion seal arranged on the rear surface of the upper aluminum cap, wherein the cushion seal is positioned axial position adjusting mechanism. The present invention has the advantages of capable of adjusting nailing power so as to provide maximum output power and is convenient for adjusting nailing frequencies.

6 Claims, 8 Drawing Sheets

7

ADJUSTING MECHANISM FOR NAILING POWER OF NAILING GUN

CROSS REFERENCE TO RELATED PATENT APPLICATION

The present application is the US national stage of PCT/CN2009/074018 filed on Sep. 18, 2009, which claims the priority of the Chinese patent application No. 20910100556.7 filed on Jul. 7, 2009, which application is incorporated herein by reference.

FIELD OF THE INVENTION

The present invention relates to an adjusting mechanism for nailing power (NP) of air nailing gun (ANG).

BACKGROUND OF THE INVENTION

Firstly, during using air nailing gun, different nailing power is usually needed in accordance with the xylon of the wood or specification of the nailing gun to drive nails into board materials, such that depths of the driven nails can meet the desired requirements of the users.

The NP of ANG depends on gas pressure and gas filling volume of inner cylinder. The gas pressure is supplied by gas pump (GP) connecting with the nailing gun (NG). Although the NP can be adjusted by altering output pressure of the GP, the adjustment is too rough to be controlled. Moreover, rated pressure often exists between the pump and the gun, so the wide scope of the pressure adjustment is not allowed.

The gas inputting/filling volume of cylinder depends on the travel distance of the balanced valve. However, the existing balanced valve of the air nailing gun (ANG) is fixed, so that the travel distance can not be adjusted, which is a defect resulting that the nailing power (NP) can not be adjusted. Moreover, invariable nailing power will increase gas consumption, increase noise, and reduce live time of the nailing gun. In addition, in the case of small nailing power needed, the scope of application of the existing ANG is limited.

Therefore, if nailing depth is to be controlled as needed, the existing nailing gun will achieve it by means of hand feeling, changing the distance between muzzle and board plate, swing speed of the nailing gun when firing, so that the adjusting effect depends on proficiency level of the users. For general users, the above method is difficult to master. Moreover, since the hand feeling varies with each nailing, the nailing depths can not be uniform.

Secondly, the travel distance of the balanced valve of the nailing gun is set to an optimum value in theory so as to provide maximum output power. However, due to manufacturing errors, the travel distance of the balanced valves corresponds to the maximum output power of each nailing guns will be different. Therefore, in fact, the travel distance of most balanced valves of the nailing guns does not achieve the optimum values.

Finally, the fixed travel distance of the balanced valve is not good for adjusting nailing frequency. The travel distance of the balanced valve will accomplish a stroke at each nailing. The travel distance of the balanced valve is in negative relation to the nailing frequency. In certain cases, it is needed to provide suitable nailing frequency to satisfy the habit of the user. It is obvious that the fixed travel distance of the balanced valve is not good for adjusting nailing frequency and further impacts the using comfort.

SUMMARY OF THE INVENTION

In order to overcome the above defects, the present invention provides an adjusting mechanism for nailing power (NP) of air nailing gun (ANG) capable of adjusting NP so as to provide maximum output power and is convenient for adjusting nailing frequencies.

An adjusting mechanism for nailing power of nailing gun, comprising: a slot which is arranged in an upper aluminum cap and is co-axial with an air cylinder, so that the balanced valve airtight slides in the slot, the front side of the balanced valve is exposed to a main chamber, and the rear side of the balanced valve encloses with the inner surface of the upper aluminum cap to form a control chamber; the travel distance of the balanced valve is restricted between the cylinder and a cushion seal arranged on the rear surface of the upper aluminum cap, which is characterized in that: the cushion seal is positioned axially orientated adjusting mechanism.

Further, an annular lining is arranged in the upper aluminum cap, the lining and the balanced valve airtight sliding fit, and the lining encloses with the rear side of the balanced valve and the inner surface of the upper aluminum cap to form the control chamber.

Further, the cushion seal connects with the lining.

Still further, a spring is arranged between the cushion seal and the balanced valve so as to push the cushion seal tightly on the position adjusting mechanism. Further, the position adjusting mechanism comprises of a set of screw rod and nut, the nut of the set of screw rod and nut is fixed on the upper aluminum cap, and the end part of the screw rod of the set of screw rod and nut is settled by a rotary knob which can drive the screw rod, and the head part of the screw rod is fixed with the cushion seal; the rotary knob is connected to the screw rod by a first guidance key, and a guide groove is arranged on the surface of the screw rod so as to restrict the first guidance key to move along the axial line of the screw rod; the rotary knob is connected to the nut by a second guidance key, and an annular groove is arranged on the nut to only allow the rotary knob to rotate.

Further, a gear selector is arranged on the rotary knob and comprises a locating pear fixed on the rotary knob by a resetting spring and a recess positioned on the end part of the nut to fix the locating pearl.

Alternatively, the position adjusting mechanism is an oblique mechanism, which comprises an axial slider and a lateral slider, wherein the axial slider and the lateral slider fit with each other by the oblique plane so as to change lateral movement into axial movement; a rotatable nut fits with the lateral slider by a screw thread so as to drive the lateral slider to move laterally; and the axial slider connects with the cushion seal.

Alternatively, the position adjusting mechanism is a lever mechanism, which comprises a lever hinged on an installing seat, and the head part of the lever is pushed against an axial slider which connects with the cushion seal; and the end part of the lever has a tap hole which is traversed by a screw rod, and the rod connects with the installing seat. Alternatively, the position adjusting mechanism is a cam mechanism, which comprises a cam arranged on an installing seat, and the cam is pushed against an axial slider which connects with the cushion seal.

The concept of the present invention is that when the nailing power needs to be adjusted, the adjusting mechanism can be screwed or stirred to drive the lining forward/backward so as to adjust the travel distance of the balanced valve and change the gas filling volume of cylinder to accomplish the adjustment of the nailing power. When the balanced valve is adjusted in the predetermined position, the adjusting mechanism can lock itself to keep the location.

The balanced valve of nailing guns in the present invention can process precise fine adjustment, and the user can find out the maximum output power of the balanced valve of each gun on trial, that is benefit to exert the optimum performance of a nailing gun.

By using the negative relation between the travel distance of the balanced valve and the nailing frequency, the user can change the nailing frequency by adjusting the position of the balanced valve and to find out the most suitable nailing frequency so as to improve the using comfort.

When the travel distance of the balanced valve is set to zero, the gas filling volume of cylinder equals to zero, so that the nailing gun can not be triggered, that is to take the effect as an emergency apparatus to prevent danger of trigging by mistake or the playing by children.

The nailing gun provided by the present invention has the advantageous of being able to adjust the nailing power, to reduce the gas consumption and the noises, and to improve the live time. The nailing gun provided by the present invention is benefit to exert the maximum output power and adjust the nailing frequency. The nailing gun provided by the present invention is very safe, and the scope of application of the nailing gun can be extended, and the structure of the nailing gun is very simple and the cost of the nailing gun is very cheap.

DETAILED DESCRIPTION OF THE INVENTION

The First Embodiment

Figure 1:
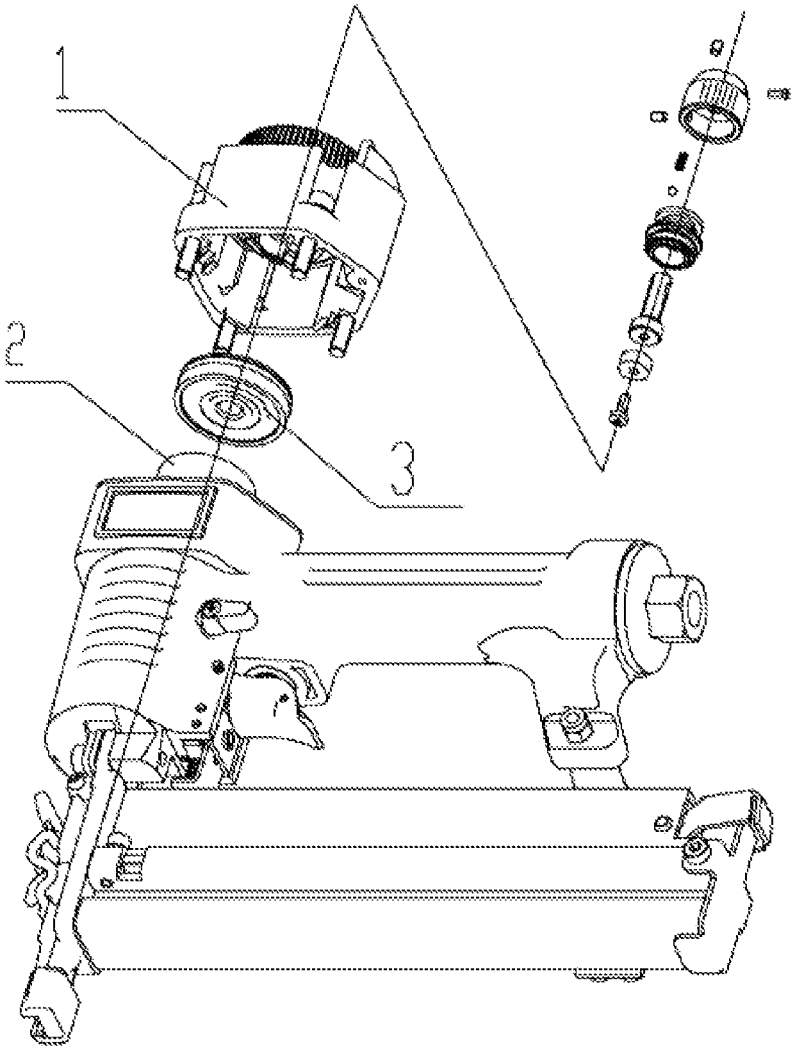
FIG. 1 is an explored view showing the present invention.
Figure 2:
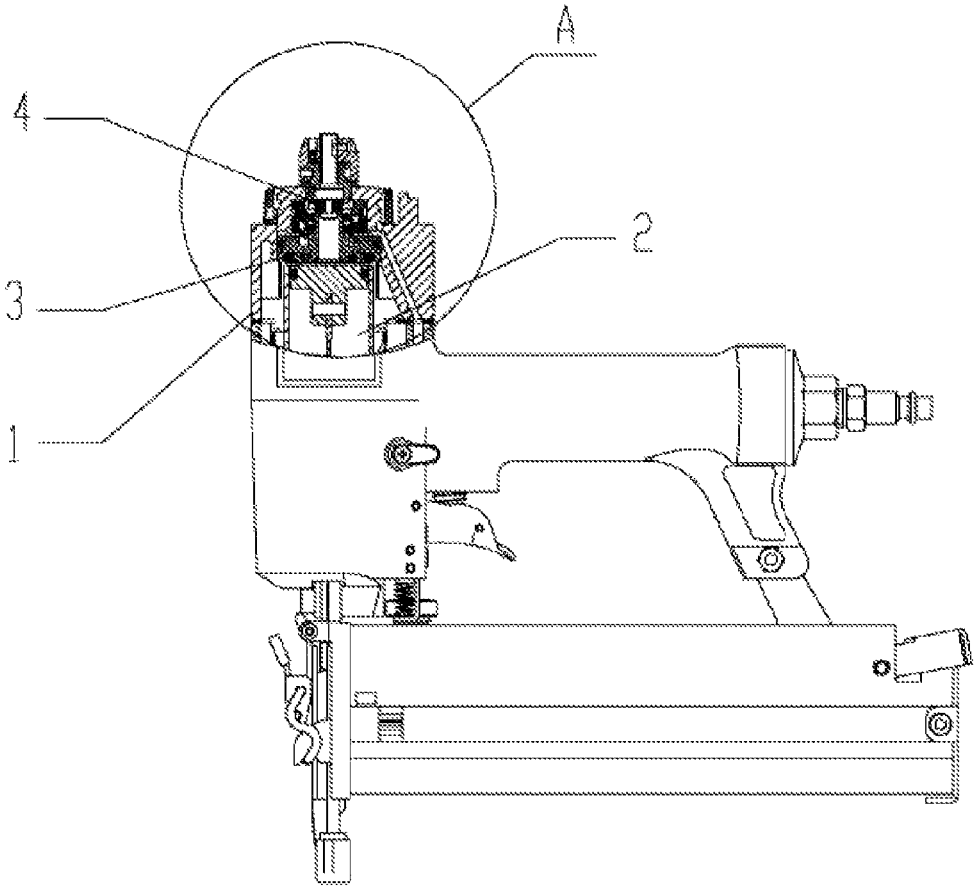
FIG. 2 is a view showing the present invention in the operation condition.
Figure 3:
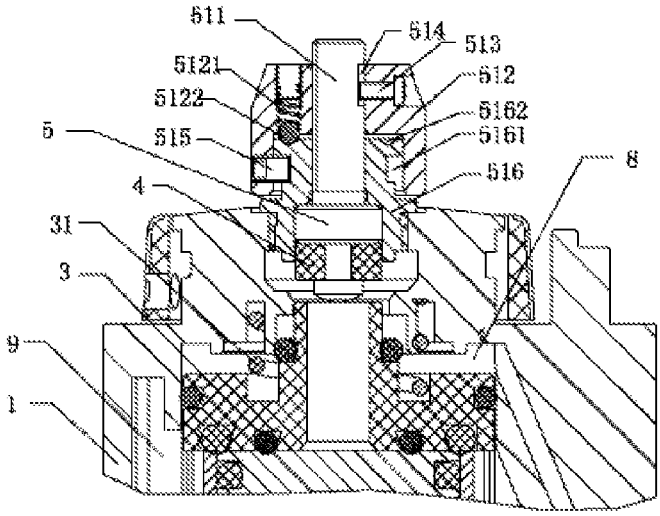
FIG. 3 is a partial view showing the first embodiment of the present invention.

Seeing FIGS. 1, 2, 3

According to the present embodiment, an adjusting mechanism for nailing power (NP) of nailing gun (NG) includes a slot which is arranged in an upper aluminum cap 1 and is co-axial with an air cylinder 2, so that a balanced valve 3 can airtight slide in the slot. The front side of the balanced valve 3 is exposed to a main chamber, and the rear side of the balanced valve 3 encloses with the inner surface of the upper aluminum cap 1 to form the control chamber 8.

The travel distance of the balanced valve 3 is restricted between the cylinder 2 and a cushion seal 4 arranged on the rear surface of the upper aluminum cap 1, wherein the cushion seal 4 is positioned on an axial position adjusting mechanism.

The position adjusting mechanism is composed of a set of screw rod and nut, wherein the nut 511 of the set of screw rod and nut is fixed on the upper aluminum cap 1, and a rotary knob 512 of the set of screw rod and nut which can drive the screw rod 511 is arranged on the end part of the screw rod 511 and the cushion seal 4 is fixed on the head part of the screw rod 511; the rotary knob 512 is connected to the screw rod 511 by a first guidance key 513, and a guide groove 514 is arranged on the surface of the screw rod 511 so as to restrict the first guidance key 513 to move along the axial line of the screw rod 511; the rotary knob 512 is connected to the nut 516 by a second guidance key 515, and an annular groove 5161 is arranged on the nut 516 to only allow the rotary knob 512 to rotate.

A gear selector, is arranged on the rotary knob 512 and comprises a locating pear 5122 fixed on the rotary knob 512 by a resetting spring 5121 and a recess 5162 positioned on the end part of the nut 516 to fix the locating pearl 5122.

The Second Embodiment

Figure 4:
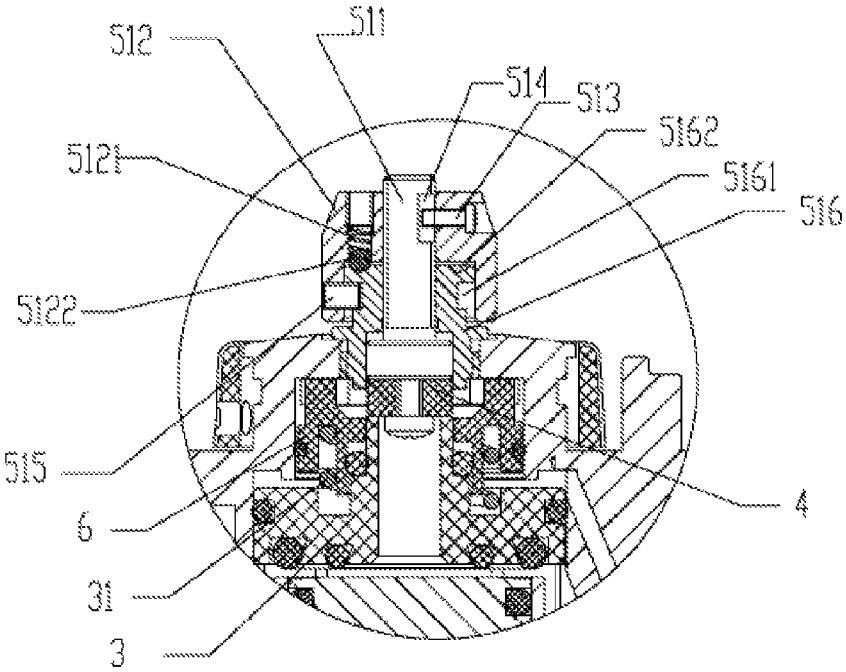
FIG. 4 is a partial view showing the second embodiment of the present invention.

Seeing FIGS. 1, 2, 4

The present embodiment differs from the first embodiment in that: an annular lining 6 is arranged in the upper aluminum cap 1, so that the lining 6 and the balanced valve 3 airtight slide fit, and the lining 6 encloses with the rear side of the balanced valve 3 and the inner surface of the upper aluminum cap 1 to form the control chamber. The other components of the second embodiment are the same as that of the first embodiment.

The Third Embodiment

Figure 5:
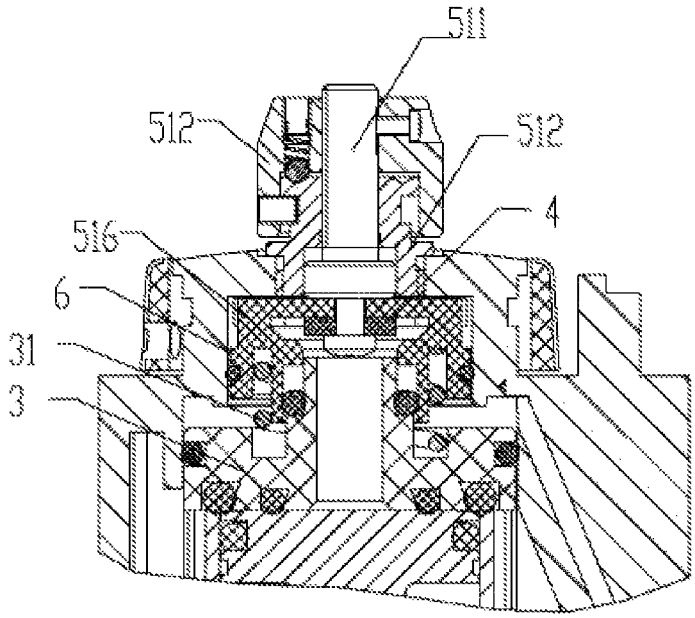
FIG. 5 is a partial view showing the third embodiment of the present invention.

Seeing FIGS. 1, 2, 5

The present embodiment differs from the second embodiment in that: the cushion seal 4 connects with the lining 6. The other components of the third embodiment are the same as that of the second embodiment.

The Fourth Embodiment

Figure 6:
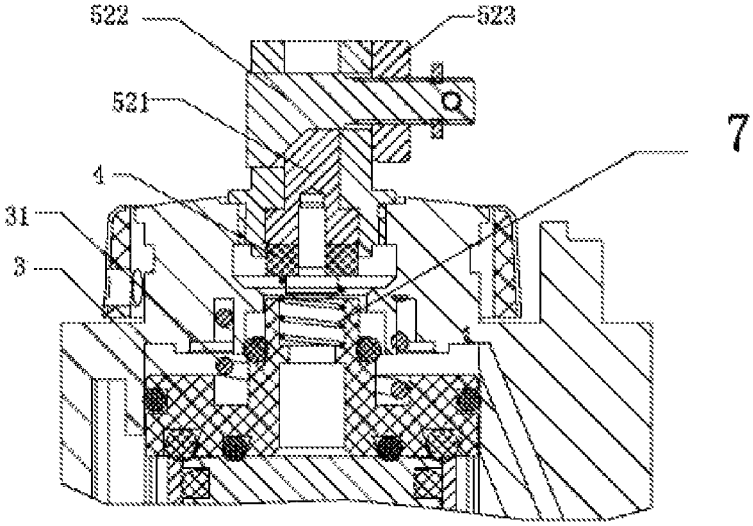
FIG. 6 is a partial view showing the fourth embodiment of the present invention.

Seeing FIGS. 1, 2, 6

The present embodiment differs from the first embodiment in that: the position adjusting mechanism is an oblique mechanism, which comprises an axial slider 521 and a lateral slider 522, wherein the axial slider 521 and the lateral slider 522 fit with each other by the oblique plane so as to change lateral movement into axial movement; a rotatable nut 523 fits with the lateral slider 522 by a screw thread so as to drive the lateral slider 522 to move laterally; and the axial slider 521 connects with the cushion seal 4.

A spring 7 is arranged between the cushion seal 4 and the balanced valve 3 so as to push the cushion seal 4 tightly against the position adjusting mechanism.

Obviously, the present embodiment can adjust the travel distance of the balanced valve by rotating the rotatable nut 523.

The other components of the fourth embodiment are the same as that of the first embodiment.

The Fifth Embodiment

Figure 7:
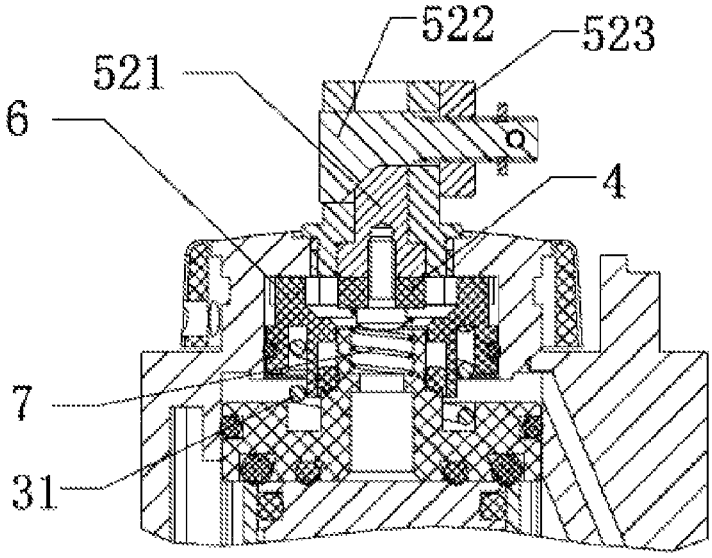
FIG. 7 is a partial view showing the fifth embodiment of the present invention.

Seeing FIGS. 1, 2, 7

The present embodiment differs from the fourth embodiment in that: an annular lining 6 is arranged in the upper aluminum cap 1, so that the lining 6 and the balanced valve 3 airtight slide fit, and the lining 6 encloses with the rear side of the balanced valve 3 and the inner surface of the upper aluminum cap 1 to form the control chamber.

The other components of the fifth embodiment are the same as that of the fourth embodiment.

The Sixth Embodiment

Figure 8:
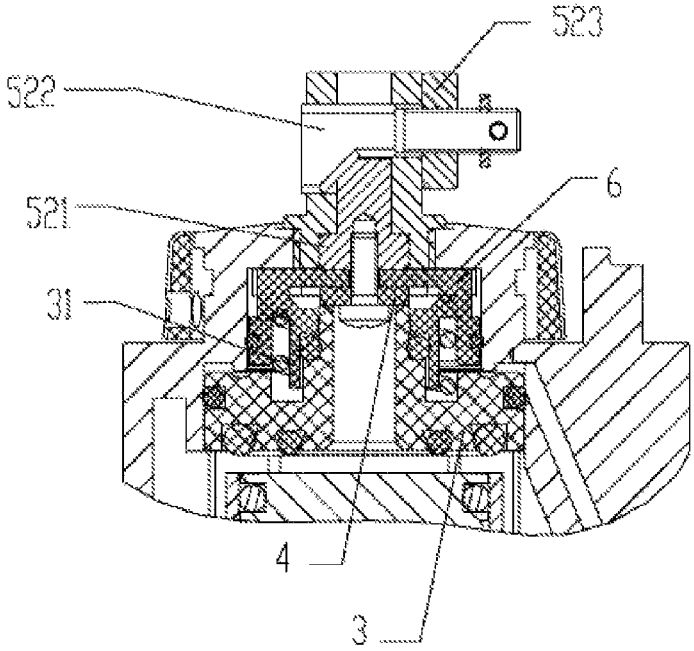
FIG. 8 is a partial view showing the sixth embodiment of the present invention.

Seeing FIGS. 1, 2, 8

The present embodiment differs from the fourth embodiment in that: the cushion seal 4 connects with the lining 6, and the spring 7 is omitted.

The self-contained spring 31 is arranged between the balanced valve 3 and the lining 6 and pushes the lining 6 and the cushion seal 4, and the axial slider 521 is pushed tightly against the lateral slider 522 so as to push the cushion seal 4 tightly on the axial position adjusting mechanism. Thereby, the present embodiment can omit the spring 7 arranged between the cushion seal 4 and the balanced valve 3. The other components of the sixth embodiment are the same as that of the fourth embodiment.

The Seventh Embodiment

Figure 9:
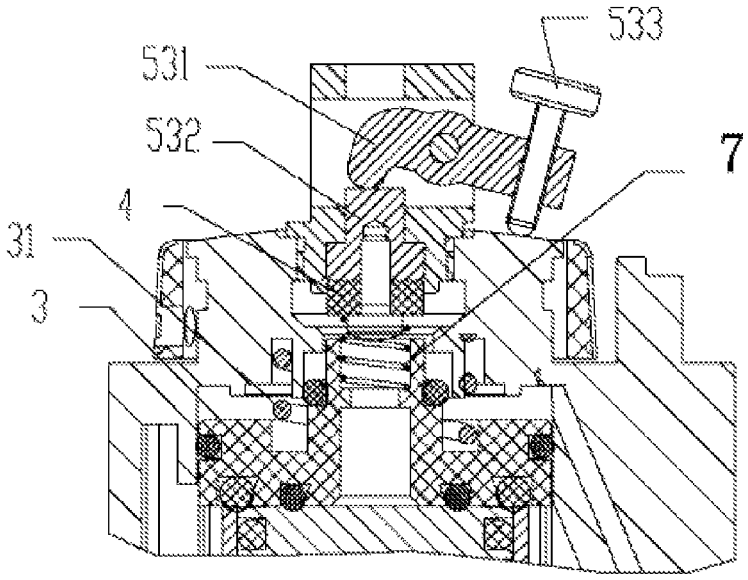
FIG. 9 is a partial view showing the seventh embodiment of the present invention.

Seeing FIGS. 1, 2, 9

The present embodiment differs from the first embodiment in that: the position adjusting mechanism is a lever mechanism, which comprises a lever 531 hinged on an installing seat, and the head part of the lever 531 is pushed against an axial slider 532 which connects with the cushion seal 4; and the end part of the lever 531 has a tap hole which is traversed by a screw rod 533 to push against the installing seat.

A spring 7 is arranged between the cushion seal 4 and the balanced valve 3 so as to push the cushion seal 4 tightly on the position adjusting mechanism.

The other components of the seventh embodiment are the same as that of the first embodiment.

The Eighth Embodiment

Figure 10:
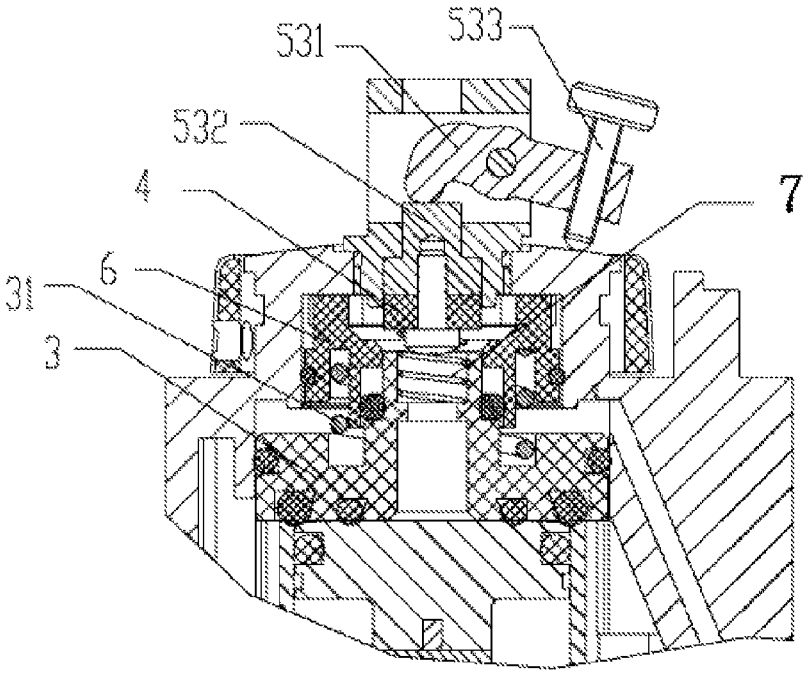
FIG. 10 is a partial view showing the eighth embodiment of the present invention.

Seeing FIGS. 1, 2, 10

The present embodiment differs from the seventh embodiment in that: an annular lining 6 is arranged in the upper aluminum cap 1, so that the lining 6 and the balanced valve 3 airtight sliding fit, and the lining 6 encloses with the rear side of the balanced valve 3 and the inner surface of the upper aluminum cap 1 to form the control chamber.

The other components of the eighth embodiment are the same as that of the seventh embodiment.

The Ninth Embodiment

Figure 11:
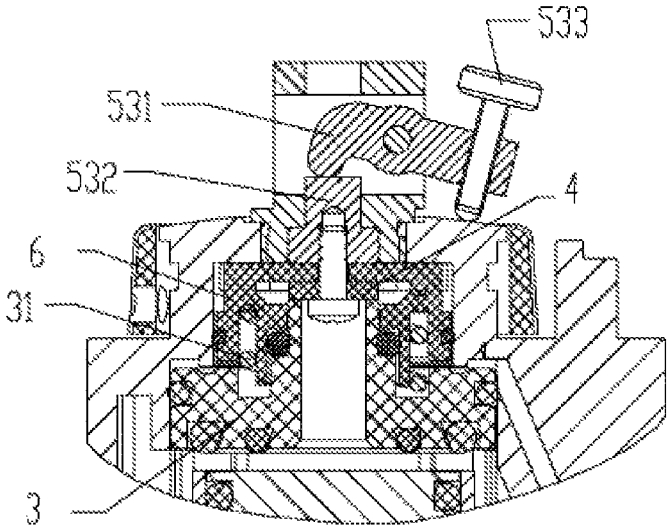
FIG. 11 is a partial view showing the ninth embodiment of the present invention.

Seeing FIGS. 1, 2, 11

The present embodiment differs from the eighth embodiment in that: the cushion seal 4 connects with the lining 6, and the spring 7 is omitted.

The self-contained spring 31 is arranged between the balanced valve 3 and the lining 6 and pushes the lining 6 and the cushion seal 4, and the axial slider 532 is pushed tightly against the lever 531 so as to push the cushion seal 4 tightly against the position adjusting mechanism. Therefore, the present embodiment can omit the spring 7 arranged between the cushion seal 4 and the balanced valve 3.

The other components of the ninth embodiment are the same as that of the eighth embodiment.

The Tenth Embodiment

Figure 12:
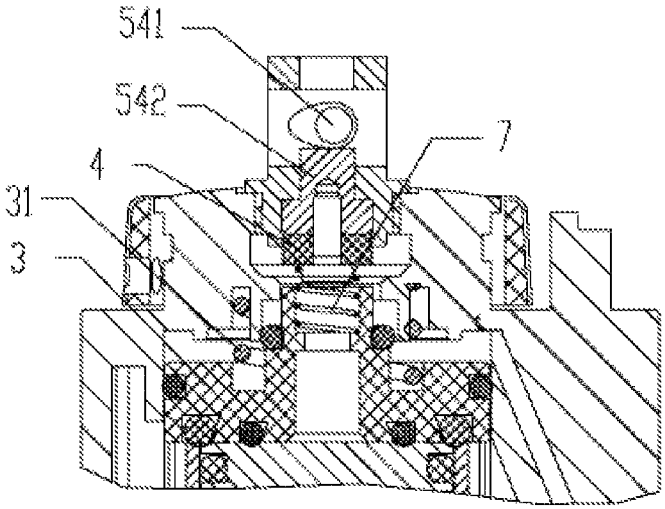
FIG. 12 is a partial view showing the tenth embodiment of the present invention.

Seeing FIGS. 1, 2, 12

The present embodiment differs from the first embodiment in that: the position adjusting mechanism is a cam mechanism, which comprises a cam 541 arranged on an installing seat, and the cam 541 is pushed against an axial slider 542 which connects with the cushion seal 4.

A spring 7 is arranged between the cushion seal 4 and the balanced valve 3 so as to push the cushion seal 4 tightly against the position adjusting mechanism.

The other components of the tenth embodiment are the same as that of the first embodiment.

The Eleventh Embodiment

Figure 13:
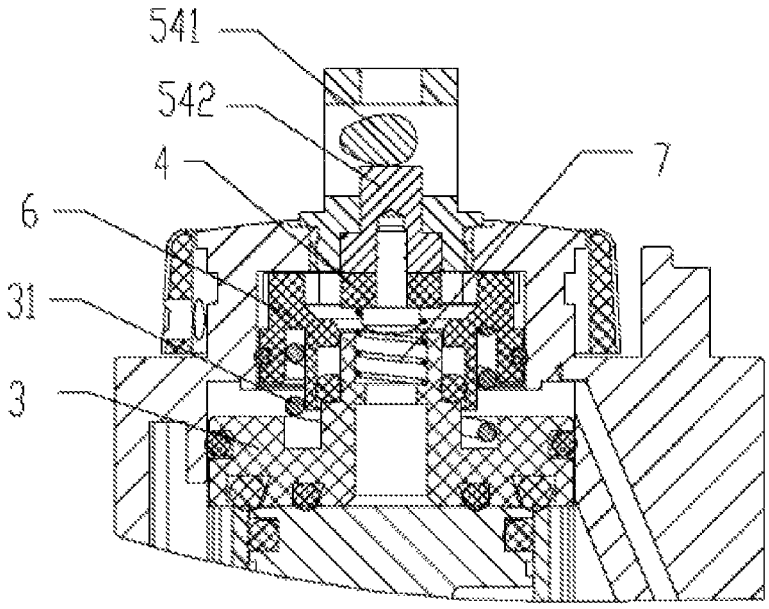
FIG. 13 is a partial view showing the eleventh embodiment of the present invention.

Seeing FIGS. 1, 2, 13

The present embodiment differs from the tenth embodiment in that: an annular lining 6 is arranged in the upper aluminum cap 1, so that the lining 6 and the balanced valve 3 airtight slide fit, and the lining 6 encloses with the rear side of the balanced valve 3 and the inner surface of the upper aluminum cap 1 to form the control chamber.

The other components of the eleventh embodiment are the same as that of the tenth embodiment.

The Twelfth Embodiment

Figure 14:
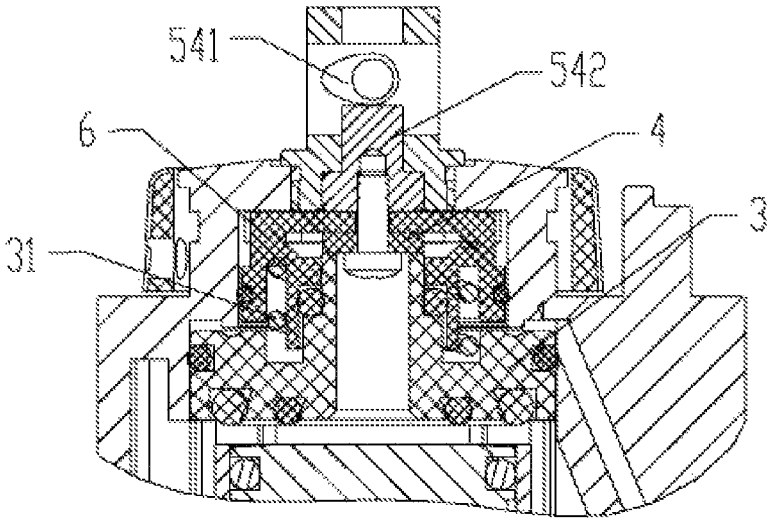
FIG. 14 is a partial view showing the twelfth embodiment of the present invention.

Seeing FIGS. 1, 2, 14

The present embodiment differs from the eleventh embodiment in that: the cushion seal 4 connects with the lining 6, and the spring 7 is omitted.

The self-contained spring 31 is arranged between the balanced valve 3 and the lining 6 and pushes the lining 6 and the cushion seal 4, and the axial slider 542 is pushed tightly against the cam 541 so as to push the cushion seal 4 tightly against the position adjusting mechanism. Therefore, the present embodiment can omit the spring 7 arranged between the cushion seal 4 and the balanced valve 3.

The other components of the twelfth embodiment are the same as that of the eleventh embodiment.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An adjusting mechanism for nailing power of nailing gun, comprising:

a slot, which is arranged in an upper aluminum cap and is co-axial with an air cylinder;

a balanced valve airtightly sliding in the slot, a front side of the balanced valve is exposed to a main chamber;

a control chamber is defined by a rear side of the balanced valve together with an inner surface of an upper aluminum cap, a travel distance of the balanced valve is restricted between the air cylinder and a cushion seal;

the cushion seal is arranged on a rear surface of the upper aluminum cap and positioned on an axial position adjusting mechanism;

the position adjusting mechanism comprises:

a set of screw rod and nut, the nut is fixed on the upper aluminum cap, and the end part of the screw rod is settled by a rotary knob which can drive the screw rod, and the head part of the screw rod is fixed with the cushion seal;

the rotatable knob is connected to the screw rod by a first guidance key, and a guide groove is arranged on the surface of the screw rod so as to restrict the first guidance key to move along the axial line of the screw rod;

the rotatable knob is connected to the nut by a second guidance key, and an annular groove is arranged on the nut to only allow the rotatable knob to rotate;

an annular lining is arranged in the upper aluminum cap to connect with the cushion seal, so that the annular lining and the balanced valve are in an airtight sliding fit, and the annular lining, the rear side of the balanced valve and the inner surface of the upper aluminum cap define the control chamber;

the position adjusting mechanism is an oblique mechanism, which comprises an axial slider and a lateral slider, wherein the axial slider and the lateral slider fit with each other by an oblique plane so as to change lateral movement into axial movement; a rotatable nut fits with the lateral slider by a screw thread so as to drive the lateral slider to move laterally; and the axial slider connects with the cushion seal.

2. The adjusting mechanism for nailing power of nailing gun according to claim 1, wherein a spring is arranged between the cushion seal and the balanced valve so as to push the cushion seal tightly on the position adjusting mechanism.

3. The adjusting mechanism for nailing power of nailing gun according to claim 1, wherein a spring is installed between the cushion seal and the balanced valve so as to push the cushion seal tightly on the position adjusting mechanism.

4. The adjusting mechanism for nailing power of nailing gun according to claim 1, wherein a gear selector is arranged on the rotatable knob and comprises a locating pearl fixed on the rotatable knob by a resetting spring and a recess positioned on an end part of the nut to fix the locating pearl.

5. The adjusting mechanism for nailing power of nailing gun according to claim 1, wherein the position adjusting mechanism is a lever mechanism, which comprises a lever hinged on an installing seat, and a head part of the lever is pushed against an axial slider which connects with the cushion seal; and an end part of the lever has a tap hole which is traversed by a screw rod, and the screw rod connects with the installing seat.

6. The adjusting mechanism for nailing power of nailing gun according to claim 1, wherein the position adjusting mechanism is a cam mechanism, which comprises a cam arranged on an installing seat, and the cam is pushed against an axial slider which connects with the cushion seal.

* * * * *